US007775735B2

(12) United States Patent
Habatjou

(10) Patent No.: US 7,775,735 B2
(45) Date of Patent: Aug. 17, 2010

(54) DEVICE AND METHOD FOR DISPENSING AND APPLYING A FLUID SUCH AS A COSMETIC PRODUCT OR A CARE PRODUCT

(75) Inventor: Jacques Habatjou, Cambrai (FR)

(73) Assignee: L'Oreal, Paris (FR)

( * ) Notice: Subject to any disclaimer, the term of this patent is extended or adjusted under 35 U.S.C. 154(b) by 756 days.

(21) Appl. No.: 11/118,362

(22) Filed: May 2, 2005

(65) Prior Publication Data

US 2005/0249541 A1 Nov. 10, 2005

Related U.S. Application Data

(60) Provisional application No. 60/572,498, filed on May 20, 2004.

(30) Foreign Application Priority Data

May 5, 2004 (FR) ..... 04 04854

(51) Int. Cl.
*B43M 11/02* (2006.01)

(52) U.S. Cl. ..... 401/220

(58) Field of Classification Search ..... 401/218–220, 401/137–139, 196–199, 205–207, 282, 283, 401/156, 162
See application file for complete search history.

(56) References Cited

U.S. PATENT DOCUMENTS

| | | | | |
|---|---|---|---|---|
| 2,029,056 | A | 1/1936 | Carlson | |
| 2,548,923 | A * | 4/1951 | Walters et al. | 15/24 |
| 2,730,738 | A * | 1/1956 | Humes | 401/208 |
| 2,999,257 | A * | 9/1961 | Estrada | 15/24 |
| 3,235,900 | A | 2/1966 | Klassen | |
| 3,658,432 | A * | 4/1972 | Lanusse | 401/219 |
| 3,724,016 | A * | 4/1973 | Soffer | 15/98 |
| 3,994,290 | A | 11/1976 | Springer et al. | |
| 4,175,300 | A * | 11/1979 | McGlew et al. | 401/205 |
| 4,302,122 | A * | 11/1981 | Moya | 401/208 |
| 4,535,499 | A * | 8/1985 | Cho | 401/208 |
| 4,875,246 | A * | 10/1989 | MacGregor | 15/98 |
| 5,105,802 | A | 4/1992 | Pokorny | |
| 5,213,431 | A * | 5/1993 | Gentile et al. | 401/219 |
| 5,322,220 | A * | 6/1994 | Rehkemper | 239/214 |
| 5,470,386 | A * | 11/1995 | Harris | 118/244 |
| 5,725,483 | A | 3/1998 | Podolsky | |
| 5,997,205 | A * | 12/1999 | Koide | 401/220 |
| 7,165,285 | B1 * | 1/2007 | Hajianpour | 15/28 |

FOREIGN PATENT DOCUMENTS

| | | |
|---|---|---|
| DE | 2 011 173 | 9/1971 |
| EP | 0 437 042 A2 | 7/1991 |
| EP | 0 779 044 A1 | 6/1997 |
| EP | 0 940 100 A1 | 9/1999 |
| WO | WO 94/21210 | 9/1994 |

* cited by examiner

*Primary Examiner*—Tuan N Nguyen
(74) *Attorney, Agent, or Firm*—Oliff & Berridge, PLC

(57) ABSTRACT

A device for dispensing and applying a fluid contained in a reservoir may include an applicator member with an outer wall that is configured to be charged with fluid contained in the reservoir and to dispense such fluid. The wall may be turnable about a single axis of rotation. The device may further include a motor arranged to drive the applicator member in rotation around the single axis of rotation.

26 Claims, 4 Drawing Sheets

DEVICE AND METHOD FOR DISPENSING AND APPLYING A FLUID SUCH AS A COSMETIC PRODUCT OR A CARE PRODUCT

This non-provisional application claims the benefit of French Application No. 04 04854 filed on May 5, 2004, and U.S. Provisional Application No. 60/572,498 filed on May 20, 2004.

BACKGROUND

The present invention relates to a device for dispensing and applying a fluid, such as a cosmetic product or a care product.

The term "cosmetic product" as used in the present invention means a product as defined in Council Directive 93/35/EEC dated Jun. 14, 1993, which amends Council Directive 76/768/EEC.

U.S. Pat. No. 3,994,290 describes a massage device comprising a rotatable massage unit rotatably driven by a motor and carrying a plurality of balls freely mounted thereover. Fluid contained in a receptacle may be dispensed to the balls via channels.

U.S. Pat. No. 5,725,483 describes a massage device comprising a motor rotatably driving a plurality of hemispherical massage elements. That device is provided with a fluid reservoir which, by means of a pump, can supply brushes disposed at the end of the hemispherical elements through orifices located at the bases of said brushes.

U.S. Pat. No. 5,105,802 describes a device comprising a rotatable head carrying a plurality of balls which are driven by a motor. The rotary head defines a space into which a fluid may be dispensed, in contact with the balls. They are rotatably mounted on the head and may be driven in rotation about themselves by the motor. The beads are thus provided with a motion which is the resultant of two rotational motions about distinct axes.

SUMMARY

The above-mentioned devices are of relatively complex structure.

The present invention aims, for example, to provide a device for dispensing and applying a fluid, which is of a relatively simple structure and which facilitates dispensing of the fluid.

Exemplary embodiments of the invention provide a device for dispensing and applying a fluid contained in a reservoir, said device comprising: an applicator member comprising an outer wall that is configured to be charged with fluid contained in the reservoir and to dispense such fluid, said wall being turnable about a single axis of rotation; and a motor arranged to drive the applicator member.

In exemplary embodiments, the outer wall of the applicator member may be rotated by a small number of parts, because said rotation occurs about a single axis of rotation.

Thus, in exemplary embodiments, the structure of the device may be relatively simple and may be made more compact.

In exemplary embodiments, the outer wall of the applicator member may be disposed close to the fluid reservoir, which may eliminate any need for specific channels to transport the fluid from the reservoir to said outer wall.

In exemplary embodiments, the motor may drive the applicator member in rotation directly or indirectly, for example, via motion transmission members, for example, to reduce a rate of rotation and increase torque.

In exemplary embodiments, the may be substantially a body of revolution about an axis of symmetry. In such embodiments, the outer wall may be rotatable about said axis of symmetry.

In exemplary embodiments, the applicator member may be rotatable about a axis of rotation that is distinct from said axis of symmetry.

In exemplary embodiments, the outer wall of the applicator member may have a shape that is substantially ellipsoidal and elongate. Alternatively, the outer wall may have a shape that is substantially ellipsoidal and flat.

In exemplary embodiments, the outer wall may be substantially spherical in shape.

In exemplary embodiments, the outer wall may be elastically deformable. The outer wall may be made out of an elastomer, for example.

In exemplary embodiments, the applicator member may comprise a core to which the outer wall is fitted. Said core may, for example, comprise a surface provided with portions in relief. The outer wall may deformable during application to come into contact with the portions in relief. Such portions in relief may produce a massaging effect when the applicator member is in contact with a surface to be treated, which may, inter alia, facilitate penetration of the fluid into skin and boost action of the fluid.

In exemplary embodiments, the outer wall may be rigid.

In exemplary embodiments, the outer wall comprises portions in relief which may, for example, comprise bosses.

In exemplary embodiments, the applicator member may include at least one housing configured to receive a member for fastening the applicator member on the device.

In exemplary embodiments, the applicator member may comprise at least one notched surface that configured to be coupled to the motor. Said notched surface may be located in said housing and the motor may extend at least in part into the housing, for example, to make the device more compact.

In exemplary embodiments, the housing may extend substantially parallel to the axis of rotation of the applicator member.

In exemplary embodiments, the applicator member may comprise a core comprising inner and outer cylinders, the inner cylinder including a notched surface and the outer cylinder including portions in relief on an outer surface thereof.

In exemplary embodiments, the applicator member may be removably mounted on the device.

In exemplary embodiments, the fluid reservoir may comprise at least one outlet orifice and the outer wall of the applicator member may be disposed in contact with or substantially in contact with the outlet orifice.

In exemplary embodiments, the reservoir may comprise a wall onto which the outlet orifice opens. Said wall may substantially match a shape of at least a portion of the applicator member. Said reservoir wall may, for example, be outwardly concave. In embodiments in which the outer wall of the applicator member is elastically deformable, said outer wall may be pressed against the outlet orifice with a certain force. Thus, when the device is not in use, the outer wall of the applicator member may act to close said outlet orifice.

In exemplary embodiments, an inside volume of the reservoir may be variable. For example, the reservoir may comprise at least one elastically deformable wall to reduce the inside volume. For example, the reservoir may comprise two elastically deformable walls facing each other.

In exemplary embodiments, the reservoir may be arranged to be removably mounted on the device to allow the reservoir to be replaced with another when empty, or to be refilled when the reservoir includes a filling orifice.

In exemplary embodiments, the device may include a switch connected to the motor and disposed, for example, beneath an elastically deformable wall of the device.

In exemplary embodiments, the device may include a compartment to house at least one battery. The compartment may be hinged to the rest of the device, for example.

In exemplary embodiments, the device may have only a single applicator member.

In exemplary embodiments, the applicator member may rotate with respect to the reservoir.

In exemplary embodiments, the reservoir may, for example, be outside the applicator member.

In exemplary embodiments, the fluid may be a cosmetic product, for example, a gel or a liquid, such as a liquid with low viscosity.

Exemplary embodiments of the invention provide a kit comprising: a device as defined above; and a plurality of applicator members. The plurality of applicator members may be arranged to be selectively and removably mountable on the device.

In exemplary embodiments, the plurality of applicator members may have different portions in relief, which may be directly or indirectly applied to a surface to be treated. Thus, for example, depending on a massaging effect desired, a user may select the applicator member having portions in relief suitable for achieving that massaging effect.

Exemplary embodiments of the invention provide an applicator member that is rotatably and removably mountable on a device as defined above.

Exemplary embodiments of the invention provide a fluid reservoir that is mountable on the device as defined above. The reservoir may include an outwardly concave wall through which at least one outlet orifice opens.

Exemplary embodiments of the invention provide a method of applying a fluid to a surface of the body. The method may comprise: providing a kit as defined above; selecting one of the plurality of applicator members; mounting the selected applicator member on the device; and applying fluid to the surface of the body using said applicator member.

Exemplary embodiments of the invention provide a device for dispensing and applying a fluid contained in a reservoir, the device comprising: a rotatable applicator member comprising an elastically deformable outer wall configured to be charged with fluid contained in the reservoir; and a motor arranged to drive the applicator member.

In exemplary embodiments, the applicator member may advantageously comprise a core with portions in relief. The elastically deformable wall may be deformable to come into contact with the portions in relief.

Exemplary embodiments of the invention provide a device for dispensing and applying a fluid contained in a reservoir, the device comprising: a rotatable applicator member comprising an outer wall with a shape that is substantially ellipsoidal and elongate and that is configured to be charged with fluid contained in the reservoir; and a motor arranged to drive the applicator member.

Exemplary embodiments of the invention provide a device for dispensing and applying a fluid contained in a reservoir, the device comprising: a rotatable applicator member comprising an outer wall that is configured to be charged with fluid contained in the reservoir. The applicator member may further include at least one housing configured to receive a member for fastening the applicator member to the device. The device may include a motor arranged to drive the applicator member.

Exemplary embodiments of the invention provide a device for dispensing and applying a fluid contained in a reservoir, the device comprising: a reservoir of variable inside volume containing a fluid and comprising at least one elastically deformable wall allowing the inside volume to be reduced; a rotatable applicator member comprising an outer wall that is configured to be charged with fluid contained in the reservoir; and a motor arranged to drive the applicator member.

Thus, in exemplary embodiments, the device need not include a pump to dispense the fluid contained in the reservoir, for example.

BRIEF DESCRIPTION OF THE DRAWINGS

The invention may be better understood from the following detailed description of non-limiting embodiments thereof, and from the accompanying drawings, in which.

DETAILED DESCRIPTION OF EMBODIMENTS

Figure 1:
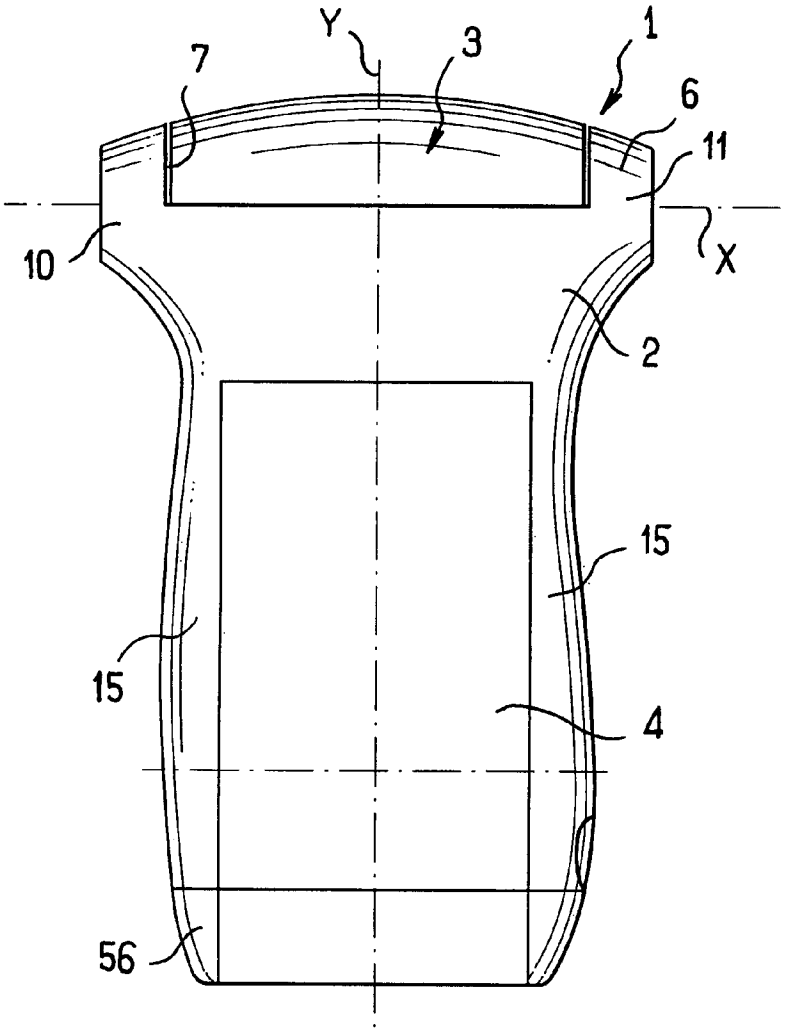
FIG. 1 is a diagrammatic elevation view of an exemplary dispenser and applicator device.

FIG. 1 shows an exemplary dispenser and applicator device 1 comprising a body 2 on which an applicator member 3 and a fluid reservoir 4 may be mounted.

In the exemplary embodiment shown, the body 2 may be made out of a thermoplastic material. Alternatively, the body 2 may be made out of any other material, for example, metal.

The upper portion of the body 2 may comprise a head 6 forming a housing 7 which may extend along an axis X and may be arranged to receive the application element 3.

Figure 2:
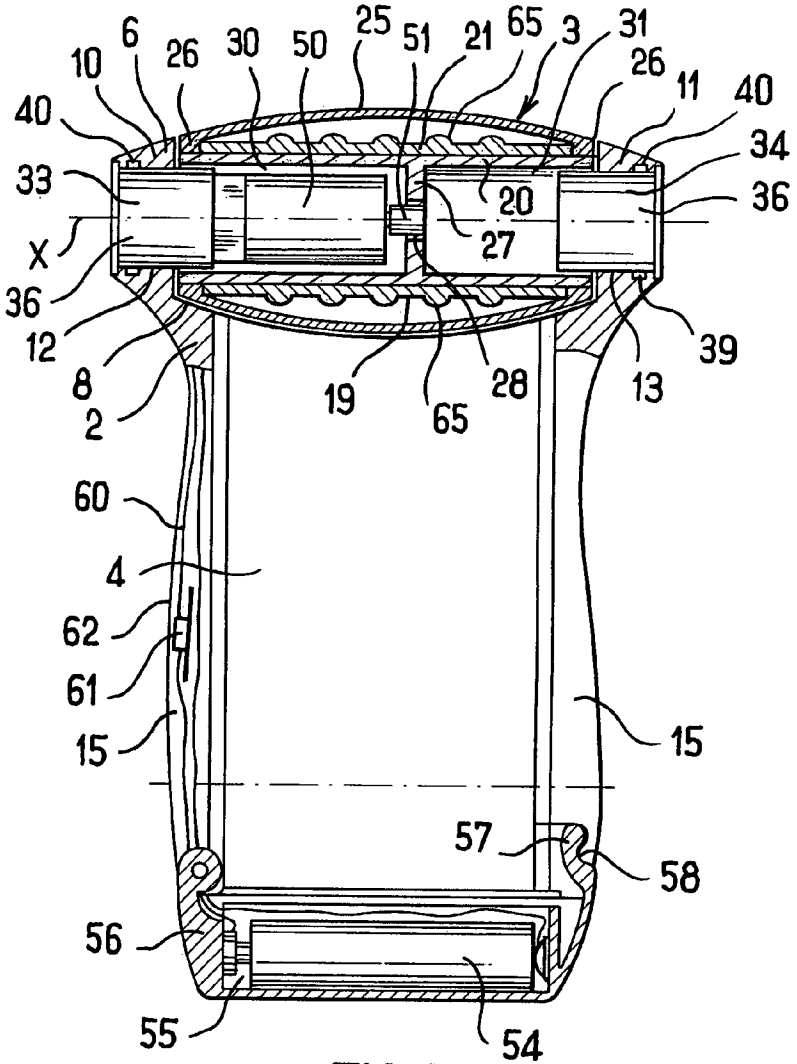
FIG. 2 is a diagrammatic axial cross-sectional view of the device of FIG. 1.

The housing 7 may include a perforated bottom wall 8, which may be substantially concave from above, as shown in FIG. 2.

The head 6 may comprise two lateral portions 10 and 11 through which pass respective openings 12 and 13, which may be substantially cylindrical with the axis X.

The housing 7 may be open at an upper portion thereof so that substantially half of the applicator member 3 is clear of the housing, for example, as shown in FIG. 1.

In the exemplary embodiment shown, below the head 6, the body 2 may also comprise two arms 15 extending along an axis Y perpendicular to the axis X.

The reservoir 4 may be removably located between the two arms 15, as explained below.

The applicator member 3 may comprise a core 19 comprising two cylinders, inner 20 and outer 21, coaxial about the axis X.

Figure 8:
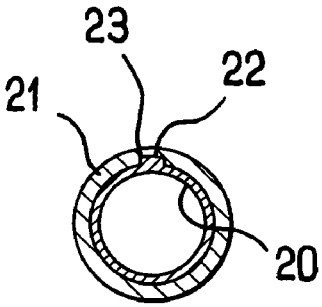
FIG. 8 is a diagrammatic cross-sectional view of the applicator member of the device of FIG. 1.

The inner cylinder 20 may comprise a first portion in relief, for example, a longitudinal rib 22, engaging in a second portion in relief of complementary shape, for example, a groove 23, of the outer cylinder 21, as illustrated in FIG. 8, for example, to immobilize the cylinders 20 and 21 in rotation when assembled together.

The inner cylinder 20 may comprise a perforated transverse internal wall 27 perpendicular to the axis X and including a notched surface 28 at the perforation.

On either side of the transverse wall 27, the cylinder 20 may define two housings 30 and 31 arranged to respectively receive two fastener members 33 and 34 made out of thermoplastic material, for example.

Figure 7:
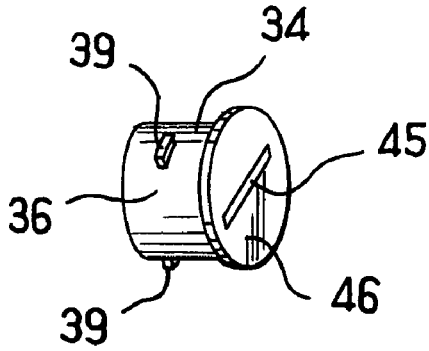
FIG. 7 is a diagrammatic perspective view of a member for fastening the device of FIG. 1.

In the exemplary embodiment shown, each of the fastener members 33 and 34 may comprise a cylindrical body 36 of axis X provided with pins 39, as shown in FIG. 7 for the fastener member 34.

Each fastener members 33 or 34 may be introduced through a corresponding opening 12 or 13 of the head 6 into the associated housing 30 or 31 of the core 19, for example, to retain the applicator member 3 in a rotatable manner about the axis X.

The fastener member 33 and 34 may be locked onto the lateral portions 10 and 11 by cooperation of pins 39 in recesses 40 provided on said lateral portions 10 and 11.

In the exemplary embodiment shown, after locking, the fastener members 33 and 34 may be locked in rotation with respect to portions 10 and 11.

The fastener members 33 and 34 may, for example, be locked on said portions 10 and 11 by turning the members 33 and 34 through a predetermined angle, for example, a quarter turn.

Said rotation may, for example, be carried out using a specific tool cooperating with a groove 45 provided on a head 46 of the fastener member 33, 34, as shown in FIG. 7.

The fastener members 33 and 34 may be unlocked and withdrawn, when necessary or desired.

The fastener member 33 may carry an electric motor 50 provided with a drive member 51, which may be in the form of a pinion, as shown in the exemplary embodiment. Said drive member 51 may engage with the notched surface 28 of the cylinder 20 to drive the applicator member 3 in rotation about the axis X.

In the exemplary embodiment shown, the motor 50 may drive the applicator member 3 directly.

Figure 9:
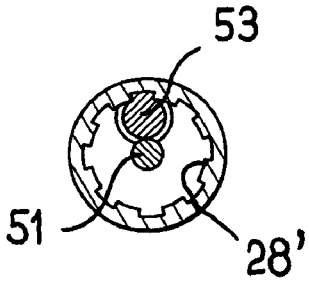
FIG. 9 is a diagrammatic cross-sectional view of exemplary gearing between the axle of the motor and the applicator member.

Alternatively, as shown in FIG. 9, it is possible to interpose a planetary gear 53 between the pinion 51 of the motor 50 and a notched surface 28' of the applicator member 3.

Figure 3:
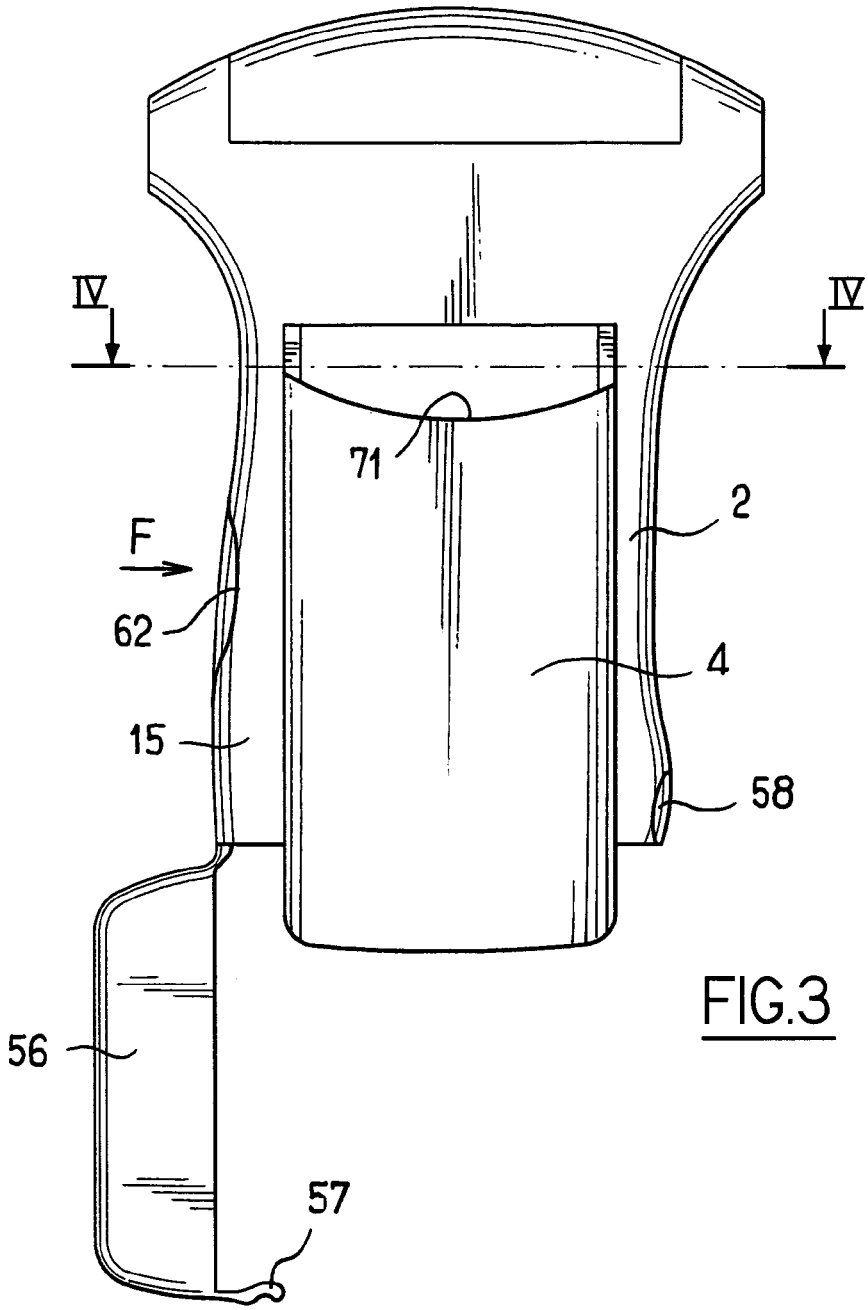
FIG. 3 is a diagrammatic view of the device of FIG. 1, the fluid reservoir being partially withdrawn.

The motor 50 may be powered by an electrical power supply, for example, one or more optionally-rechargeable batteries 54 housed in a compartment 55 formed in a cover 56 hinged to the body 2. Said cover 56 may comprise a closing tab 57 arranged to snap fit into a recess 58 provided on the body 2, for example, as shown in FIG. 3.

The electrical power supply may be connected to the motor 50 via wires 60 housed in one arm 15 of the body 2, as illustrated in FIG. 2.

The device 1 may include a switch 61 to control the function of the motor 50. Said switch 61 may be disposed on one of the arms 15 and covered, for example, by an elastically deformable wall 62.

The outer face of the outer cylinder 21 may include a plurality of portions in relief 65, which may be constituted by bosses, as shown in the exemplary embodiment.

The applicator member 3 may also comprise an outer wall 25 that is configured to be charged with fluid contained in the reservoir 4 and, in the exemplary embodiment shown, may have a substantially ellipsoidal shape, extending along the axis X.

The outer wall 25 may be, for example, in the form of an elastically deformable sleeve made out of an elastomer.

In the exemplary embodiment shown, the outer wall 25 may comprise flanges 26 at ends thereof. The flanges 26 may hold the outer wall 25 axially in place on the core 19.

The outer wall 25 may be fastened to the core 19 by any other means, for example, by bonding.

Figure 10:
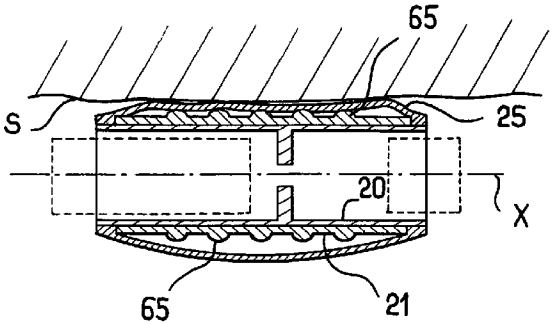
FIG. 10 is a fragmentary diagrammatic longitudinal cross-sectional view of the applicator member of the device of FIG. 1 showing the applicator member pressed against a surface to be treated.

As shown in FIG. 10, when the applicator member 3 is brought into contact with a surface S to be treated, for example skin, the elastically deformable wall 25 may be locally compressed so as to bear on the bosses 65. The bosses 65 may exert a massaging effect on the surface S through the outer wall 25 during rotation of the applicator member 3.

Figure 4:
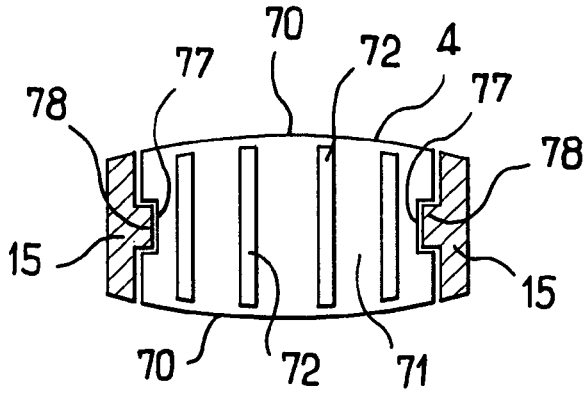
FIG. 4 is a diagrammatic cross-sectional view of the device of FIG. 3 taken along line IV-IV.

In the exemplary embodiment shown, the reservoir 4 may include an inside volume that is variable and may comprise two elastically deformable walls 70 disposed facing each other, as shown in FIG. 4.

The reservoir 4 may include an top wall 71, which may be substantially concave from above, and may be provided with one or more outlet orifices 72.

As shown in FIG. 4, the outlet orifice or orifices 72 may be in the form of slots, which may be parallel, for example. Alternatively or additionally, the outlet orifices 72 may be of any other shape, for example circular.

The reservoir 4 may also comprise a filling orifice 73, for example opposite the outlet orifice or orifices.

Figure 5:
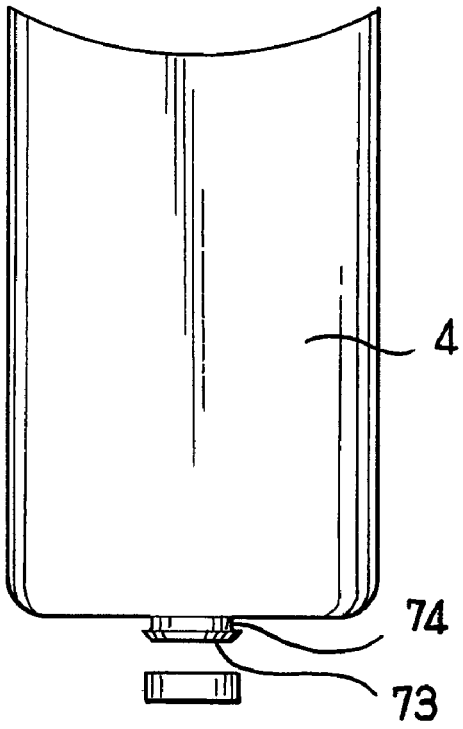
FIGS. 5 and 6 are fragmentary diagrammatic views of two exemplary embodiments of a fluid reservoir.

The filling orifice 73 may, for example, be closed by a screw cap, a snap fitted cap, or may be on a neck 74 of the reservoir 4, as shown in FIG. 5.

Figure 6:
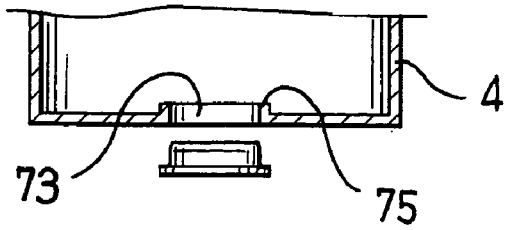

Alternatively, as shown in FIG. 6, the filling orifice 73 may be closed by a closure member which may engage, for example, by friction, in an inner skirt 75 of the reservoir 4.

In the exemplary embodiment shown, the sides of the reservoir 4 may include two longitudinal grooves 77 each intended to engage on a longitudinal rib 78 made on an arm 15, for example, to guide the reservoir 4 while being positioned on the body 2, as shown in FIG. 4.

The cover 56 may be in the open position while the reservoir is being positioned on the body 2, as shown in FIG. 3. Said cover 56 may be brought into the closed position once the reservoir 4 is in place on the body 2, as shown in FIG. 1.

When the reservoir 4 is in place on the body 2, the top wall 71 of the reservoir 4 may be positioned in the perforation in the bottom wall 8 of the housing 7. This top wall 71 of the reservoir 4 may be shaped to match a shape of the outer wall 25 of the applicator member 3.

The outer wall 25 of the applicator member 3 may be applied to the top wall 71 of the reservoir 4 with a certain force, so that the applicator member 3 may become charged with fluid coming directly from the outlet orifice or orifices 72, closing the orifice(s) while not in use, for example, improving fluid storage.

If appropriate or desired, the reservoir 4 may comprise an element for sealing the outlet orifice or orifices 72, for example, a removable film that is removed prior to first use.

The reservoir 4 may contain a cosmetic product in the form of a fluid, for example, a gel or a liquid, such as a liquid of low viscosity.

To apply the fluid, the user may switch on the motor 50, which may cause the applicator member 3 to rotate about the axis X.

In contact with the surface S to be treated, as shown in FIG. 10, the outer wall 25 of the applicator member 3 may be compressed and may come into contact with the bosses 65.

The bosses 65 may produce a massaging effect on the surface S.

The outer wall 25 may be charged with fluid through the outlet orifice or orifices 72 of the reservoir 4, for example, by pressing on the walls 70.

Since the applicator member 3 may be removably mounted on the receptacle, it is possible, if necessary or desired, to replace the applicator member 3 with another applicator member which, for example, may include bosses 65 with a different shape and/or size, for example, to produce a different massaging effect.

The device 1 may thus be provided with a plurality of applicator members 3, for example, in a kit.

The invention contemplates the case in which the shape of the outer wall 25 of the applicator member 3 is other than an ellipsoidal elongate shape.

Figure 11:
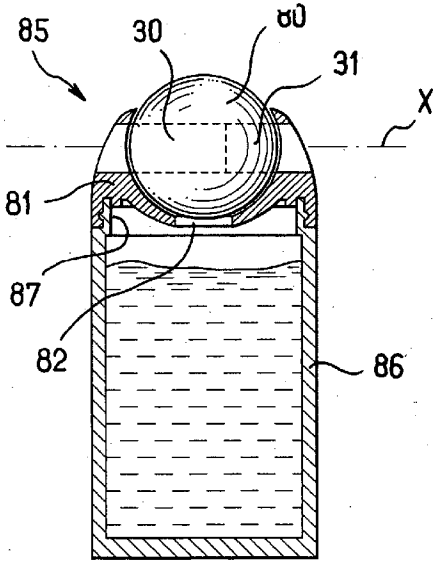
FIG. 11 is a diagrammatic cross-sectional view of another exemplary dispenser and applicator device.

As shown in FIG. 11, the device 85 may comprise an applicator member 80 with an outer wall 80*a* having a substantially spherical shape.

Said applicator member 80 may include housings 30 and 31 that enable fastener members (not shown) to be housed therein.

The applicator member 80 may be mounted on a support 81 through which a single outlet orifice 82 passes.

The support 81 may be fastened on a neck 87 of a receptacle 86 forming a reservoir for the fluid.

The invention is not limited to the embodiments and implementations described above.

For example, it is possible to provide an applicator member with a core constituted, for example, by a single cylinder, and the outer wall 25, which may or may not be rigid, and may carry portions in relief, in particular bosses, intended to produce a massaging effect.

Throughout the description, including the claims, the expression "comprising a" should be understood to be synonymous with "comprising at least one", unless otherwise indicated.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device for dispensing and applying a cosmetic fluid, said device comprising:

a reservoir containing the cosmetic fluid, the cosmetic fluid being for application to the skin;

an applicator member comprising:

an elastically deformable outer wall that is configured to be charged with the cosmetic fluid contained in the reservoir and to dispense such cosmetic fluid, said wall being turnable about a single axis of rotation, a core on which the outer wall is fitted, said core including a surface with a plurality of protrusions configured to produce a massaging effect, wherein the outer wall is deformable during application to come into contact with the plurality of protrusions, and a motor arranged to drive the applicator member in rotation about said axis.

2. A device according to claim 1, wherein the outer wall is substantially a body of revolution about an axis of symmetry.

3. A device according to claim 2, wherein said axis of symmetry is the single axis of rotation.

4. A device according to claim 1, wherein the outer wall comprises a shape that is substantially ellipsoidal and elongate.

5. A device according to claim 1, wherein the outer wall comprises a shape that is substantially spherical.

6. A device according to claim 1, wherein the outer wall is made out of elastomer.

7. A device according to claim 1, wherein the outer wall comprises a plurality of protrusions.

8. A device according to claim 7, wherein the plurality of protrusions of the outer wall comprise bosses.

9. A device according to claim 1, wherein the applicator member comprises at least one housing arranged to receive a member that fastens the applicator member on the device.

10. A device according to claim 9, wherein the motor extends at least in part into the housing.

11. A device according to claim 1, wherein the applicator member comprises at least one notched surface configured to couple to the motor.

12. A device according to claim 1, wherein the core comprises an inner cylinder and an outer cylinder, the inner cylinder comprising a notched surface configured to engage with the motor and the outer cylinder comprising the plurality of protrusions on an outer surface thereof.

13. A device according to claim 1, wherein the applicator member is removably mounted on the device.

14. A device according to claim 1, further comprising at least one outlet orifice associated with the reservoir, wherein the outer wall of the applicator member is substantially in contact with the outlet orifice.

15. A device according to claim 14, further comprising a wall onto which the at least one outlet orifice opens, said wall substantially matching a shape of at least a portion of the applicator member.

16. A device according to claim 15, wherein said wall is substantially concave toward the applicator member.

17. A device according to claim 14, wherein the outer wall of the applicator member is elastically deformable and arranged to be applied against the at least one outlet orifice with a certain force.

18. A device according to claim 1, the reservoir having a variable inside volume, the reservoir comprising at least one elastically deformable wall that allows the inside volume to be reduced.

19. A device according to claim 1, the reservoir being removably mounted on the device.

20. A device according to claim 1, the reservoir including a filling orifice.

21. A device according to claim 1, the cosmetic fluid being a gel.

22. A device according to claim 1, the cosmetic fluid being a liquid.

23. A device according to claim 22, wherein the liquid has a low viscosity.

24. A kit comprising:

a device as defined in claim 1; and a plurality of applicator members, said applicator members being selectively and removably mountable on the device.

25. A kit according to claim 24, wherein the applicator members include different pluralities of protrusions.

26. A method for applying a fluid to a surface of skin of a body, the method comprising:

providing a kit according to claim 24;

selecting one of the plurality of applicator members;

mounting the selected applicator member on the device; and applying fluid to the surface of the body using said applicator member.

* * * * *